US005437230A

United States Patent [19]

Harris et al.

[11] Patent Number: 5,437,230

[45] Date of Patent: Aug. 1, 1995

[54] STANDOFF MINE NEUTRALIZATION SYSTEM AND METHOD

[75] Inventors: Gordon L. Harris; Stephen L. Harris, both of Rancho Santa Fe; Neil A. Levy, Encinitas, all of Calif.

[73] Assignee: Leigh Aerosystems Corporation, Carlsbad, Calif.

[21] Appl. No.: 207,217

[22] Filed: Mar. 8, 1994

[51] Int. Cl.[6] ..... F42D 3/00

[52] U.S. Cl. ..... 102/302; 102/303; 102/504

[58] Field of Search ..... 102/302, 303, 504

[56] References Cited

U.S. PATENT DOCUMENTS

| | | | |
|---|---|---|---|
| 1,757,788 | 5/1930 | West | 102/23 |
| 2,925,038 | 2/1960 | Walker | 102/23 |
| 2,973,164 | 2/1961 | Grill | 102/7 |
| 3,088,403 | 5/1963 | Bartling et al. | 102/7 |
| 3,486,178 | 12/1969 | Savage | 9/14 |
| 3,648,613 | 3/1972 | Cunn | 102/22 |
| 4,228,737 | 10/1980 | Kahn et al. | 102/3 |
| 4,296,894 | 10/1981 | Schnabele et al. | 244/3.27 |
| 4,829,900 | 5/1989 | Van der Westhuizen et al. | 102/303 |
| 4,896,845 | 1/1990 | Peretti et al. | 244/3.1 |
| 5,141,175 | 8/1992 | Harris | 244/3.25 |

*Primary Examiner*—Peter A. Nelson
*Attorney, Agent, or Firm*—Edward A. Sokolski

[57] ABSTRACT

An unpowered air vehicle, i.e. a glider, which is air-launched from appreciable range, is densely packed with a large area, explosive net. At a pre-determined location, the net is extracted from the glider by a parachute and expanded completely before landing on the surface of the water or land that contains a large field of mines. The explosive material in the net is then detonated, destroying the mines covered by the net. The longitudinal ends of the net are attached to a folding, multi-arm framework designed to expand and thereby spread the net after separation from the glider. The spreading action is initiated by an extraction parachute which pulls the first frame from the air vehicle. The spreading action is completed by the second frame which is coupled to a brake mechanism in the glider that maintains tension throughout the net to complete the spreading of the net.

9 Claims, 4 Drawing Sheets

STANDOFF MINE NEUTRALIZATION SYSTEM AND METHOD

BACKGROUND OF THE INVENTION

1. Field of the Invention

This invention relates to the neutralization of water and land based mine fields, and more specifically, to the destruction of such mine fields by deploying a large-area, explosive net over the mine field from an air-launched vehicle and then detonating the net to destroy the mines.

2. Description of the Prior Art

The operations of amphibious landing forces are subject not only to exposure to enemy fire, but also to the hazards of water borne and land borne mine fields. Wide assault lanes are required for moving troops and vehicles from the sea to the shore, and these lanes must be cleared of mines in advance of landings, preferably without substantial risk to either personnel or to high value equipment. The U.S. Navy has developed a method for destroying the mines within an assault lane by covering the assault lane with nets constructed of explosive material. The detonation of the nets destroys the mines covered by the nets. The Navy deploys multiple, overlapping nets from ships positioned close to the shore or from nearby locations on shore. Rockets pull the bundled nets from the ships' decks and deploy (spread) the nets over the assault lane. The Navy's method uses overlapping nets to completely cover the assault lane. Unfortunately, the deployment method exposes landing forces to hostile fire and the accumulation of errors in this method of deploying the nets makes it difficult to achieve complete coverage of the assault lane. No other method of the prior art provides a reliable means for deploying explosive nets of this general type over an assault lane from a safe distance.

BRIEF SUMMARY OF THE INVENTION

The present invention uses an unmanned gliding vehicle (a "glider") to carry and deploy a single detonating net over an entire assault lane, which assault lane consists of a surf-zone and a beach area. A manned aircraft (e.g. a fixed-wing aircraft or a helicopter) launches the glider into the air at a relatively safe distance from the shore or other area over which the explosive net is to be deployed. After gliding to a position near the shore, the glider ejects the explosive net and its deployment system over the assault lane.

The device of the present invention comprises an air transportation vehicle such as a glider and an explosive net consisting of an array of longitudinal and lateral lines, all or some of which lines are made of explosive material or have explosive charges attached thereto. The forward and aft ends of the net are attached respectively to forward and aft metal or composite material frames that fold and telescope for storage, together with the net, in a compact configuration within the glider. The net and the attached frames are packed within the glider using an efficient packing method that ensures reliable and complete net expansion. When the net is extracted from the glider, the frames unfold and extend so as to spread the net to its "fully open" configuration. Tension on the longitudinal lines of the net maintains the net in the "fully open" configuration while the net is being deployed onto the water or ground.

DETAILED DESCRIPTION OF THE INVENTION

Figure 1:
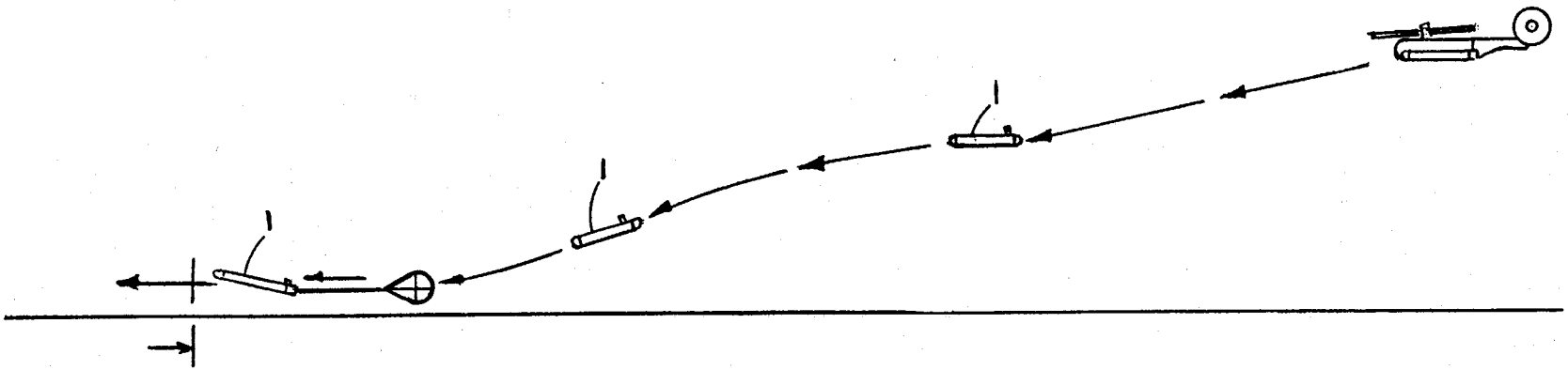
FIG. 1 depicts the flight profile of the glider.

FIG. 1 depicts the scenario of net deployment which begins with the launching of glider 1 by an aircraft, followed by glider 1 gliding to the net deployment area. Following launch, glider 1 normally would glide at a speed of approximately 120 knots to obtain the maximum range. Prior to reaching the net deployment area, glider 1 increases its angle of glide to obtain the desired speed of approximately 150 knots for deployment of net 2 (depicted in FIG. 2). Glider 1 then levels off at an altitude of approximately 50 to 80 feet above the water or ground and begins deployment of net 2 (depicted in FIG. 2). Although, a glider is used in the preferred embodiment, it should be understood that a manned or unmanned powered air transportation vehicle could, instead, be used to transport the net to the area of deployment. Accordingly, in this disclosure and in the claims, references to a "glider" and to "an air transportation vehicle" are to be understood to encompass both powered and unpowered air transportation vehicles.

Figure 2A:
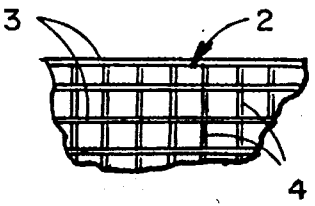
FIG. 2A depicts in detail the construction of the net.

Referring now to FIG. 2A, in the preferred embodiment net 2 consists of longitudinal members 3 and lateral members 4. The longitudinal members are long pieces of extruded plastic explosive over-braided with a high tensile strength material such as Kevlar which bears the longitudinal tension loads in the net during extraction, spreading and impact. The lateral members are designed to position and uniformly separate the longitudinal members. The lateral members may also include explosive material. The longitudinal members 3 and the lateral members 4 may also be made of non-explosive material if explosive charges are attached to and distributed over net 2.

Figure 2:
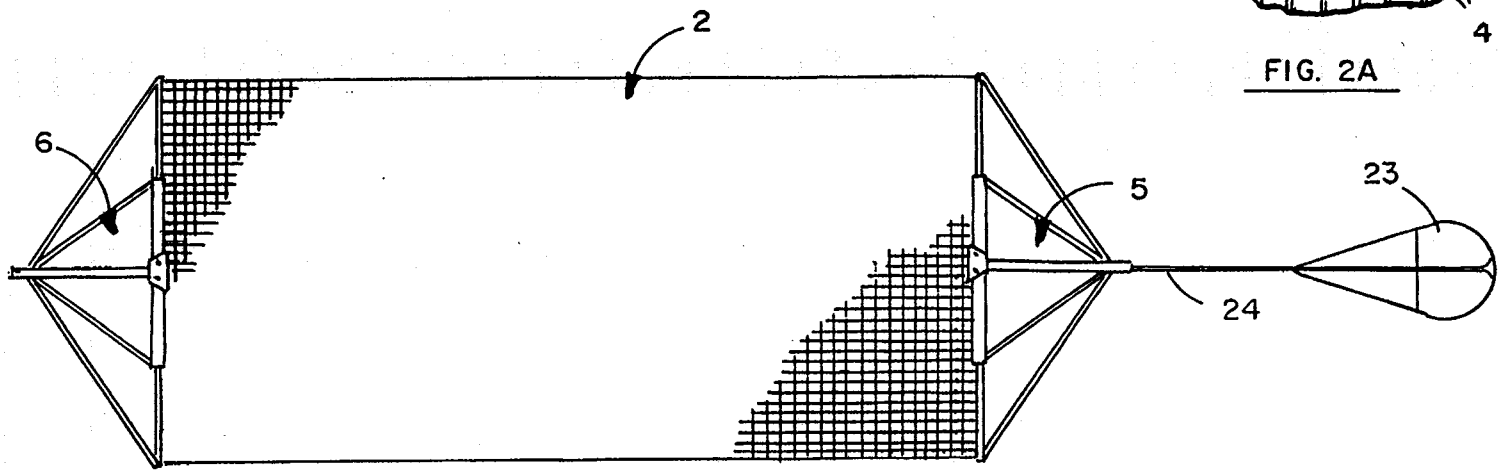
FIG. 2 depicts the net after it has been completely extracted from the glider.
Figure 3:
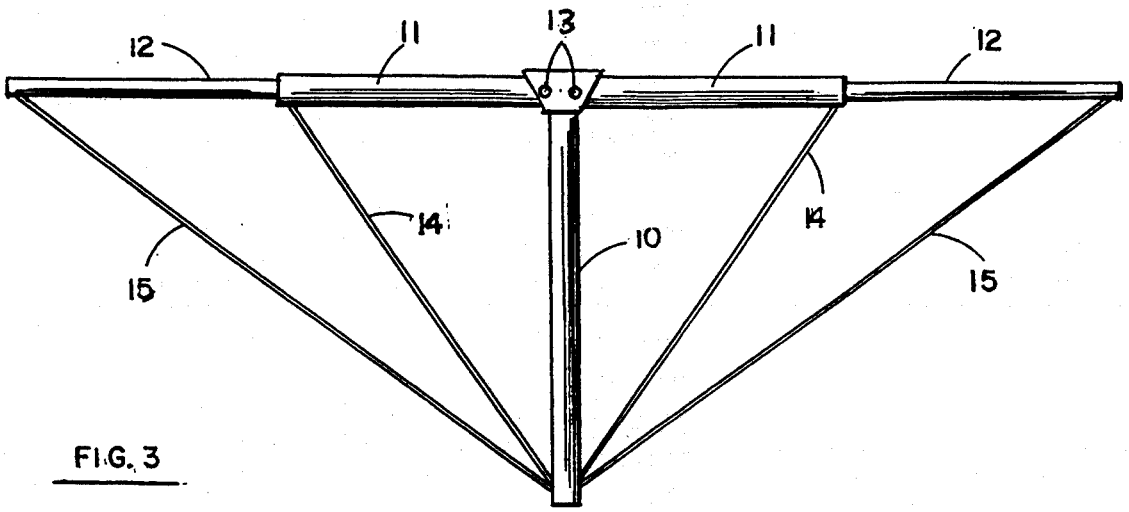
FIG. 3 depicts the general construction of the forward and aft net spreader frame assemblies.
Figure 4:
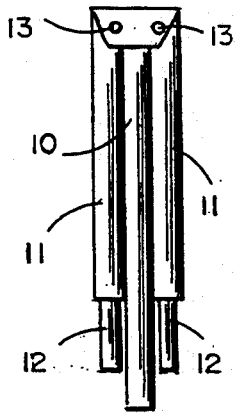
FIG. 4 depicts one of the net spreader frame assemblies in its collapsed and telescoped configuration.

As depicted in FIG. 2, net 2 is attached at its longitudinal ends to aft net spreader frame assembly 5 and to forward net spreader frame assembly 6. As depicted in FIG. 3, assemblies 5 and 6 each consist of a rigid central member 10, a pair of rigid lateral arm members 11 attached to the central member at hinges 13, a pair of telescoping rigid lateral arm members 12, and two sets of flexible lines 14 and 15. Although only two sets of flexible lines are depicted, it should be understood that a greater or lesser number of lines could instead be used. Members 10, 11 and 12 are constructed of a high strength-to-weight ratio material such as graphite composite and lines 14 and 15 are constructed of a high tensile strength line such as Kevlar rope. As depicted in FIG. 4, while stowed within glider 1 each arm member 11 is folded about hinge 13 so as to lie next to and nearly parallel to central member 10 and each arm member 12 is nested in a telescopic fashion almost entirely within its companion arm member 11.

Figure 5:
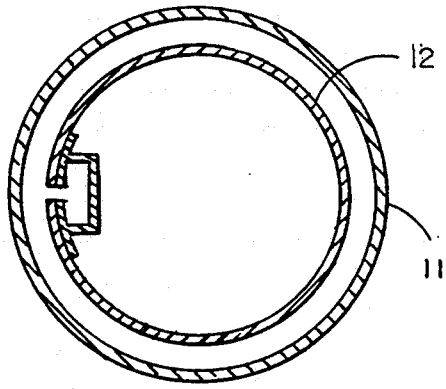
FIGS. 5, 5A and 5B depict the sliders by which a portion of the longitudinal members of the net are attached to the net spreader frame assembly.
Figure 5A:
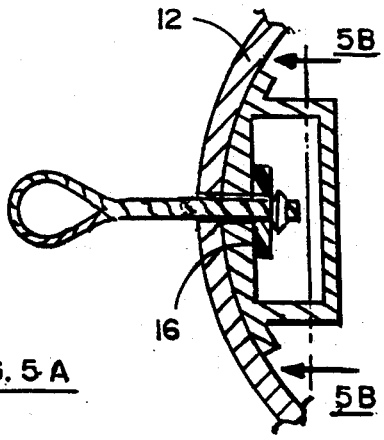
Figure 5B:
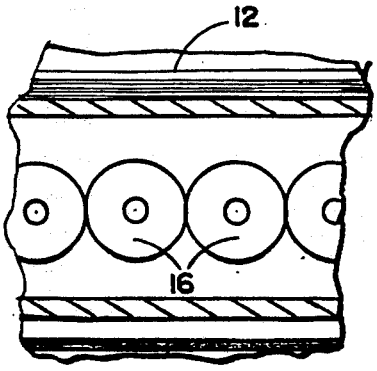

Referring now to FIGS. 5, 5A and 5B, net 2 is attached to arm members 11 at fixed points, and attached to arm members 12 by Delrin sliders 16. In the stowed position the portion of net 2 that is attached to arm member 12 is bundled about the small portion of each arm member 12 that extends outside of the respective arm member 11. Upon deployment each arm member 12 pulls the net laterally in "shower curtain" fashion.

Forward net spreader frame assembly 6 is geometrically identical to aft net spreader frame assembly 5.

Figure 6:
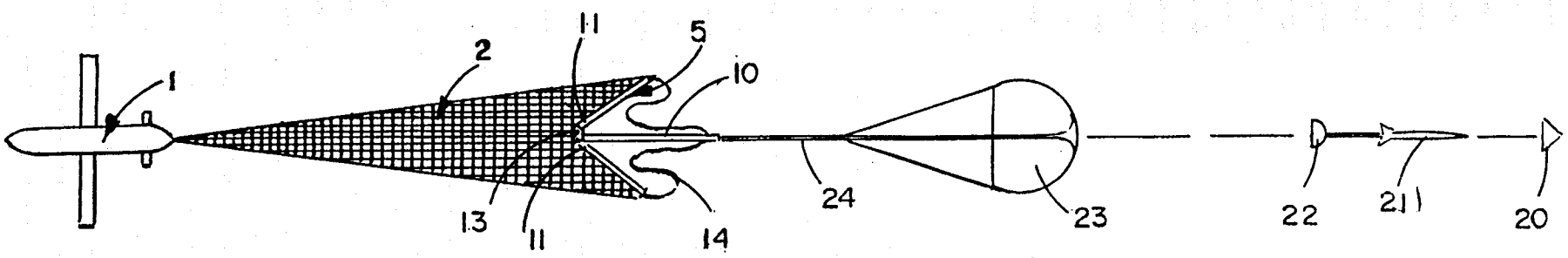
FIG. 6 depicts the stage in the net deployment at which approximately one-quarter of the net has been extracted from the glider.

Referring now to FIG. 6, at a precise distance from the area over which net 2 is to be deployed, tail cone 20 of glider 1 is ejected, tractor rocket 21 then ignites and pulls parachute bag 22 from glider 1. Parachute bag 22 then releases parachute 23, which parachute then opens in the slip stream of air about glider 1 and pulls aft net spreader frame assembly 5 and the aft portion of net 2 from glider 1. In the preferred embodiment, the tractor rocket 21 and parachute 23 together operate as an extraction device to extract net 2 and assemblies 5 and 6 from the glider. Frame assembly extraction riser 24 connects parachute 23 to aft net spreader frame assembly 5 and is built of a special high-elongation material that stretches to reduce the high peak forces that otherwise would arise as the parachute pulls net 2 from the glider. The tension in riser 24 that is created by extraction parachute 23 forces arm members 11 to rotate outward about hinges 13. Flexible lines 14 are fully extended when arm members 11 are oriented perpendicular to central member 10.

Figure 7:
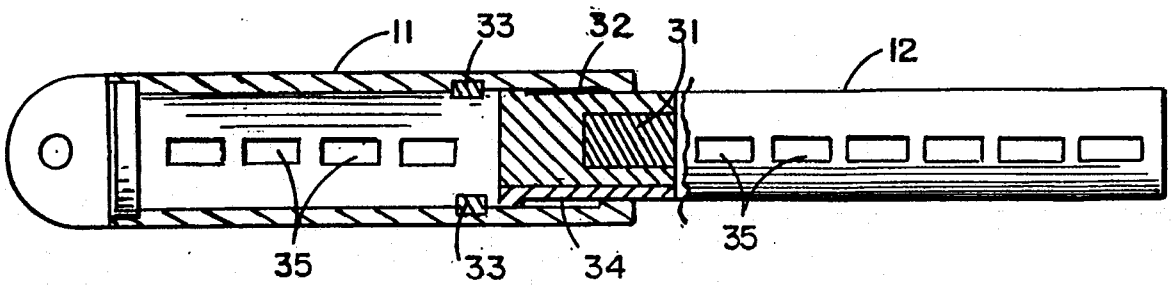
FIG. 7 shows the slots in the arm members of the net spreader frame assemblies.

Referring now to FIG. 7, after aft spreader frame assembly 5 clears glider 1, assembly 5 unfolds and rockets 31 then ignite and drive arm members 12 to their extended positions. Snubber 32 at the end of each arm 11, which snubber could be a crushable metal cylinder or similar device, stops the outward motion of arm 12 by absorbing its kinetic energy. After extension, each arm 12 is latched in the fully extended position by spring-load pins 33 (similar to door latches) or a similar acting device. Head shield 34 mitigates the temperature rise within the spreader frame arm assembly by entraining cold air via jet pump action so as to reduce heat transfer to the spreader frame arm assembly, thus protecting the adjacent net components and attachments from heat damage. The opening of net spreader frame assembly 5 causes the aft end of net 2 to expand rapidly to the net's full width.

Figure 8:
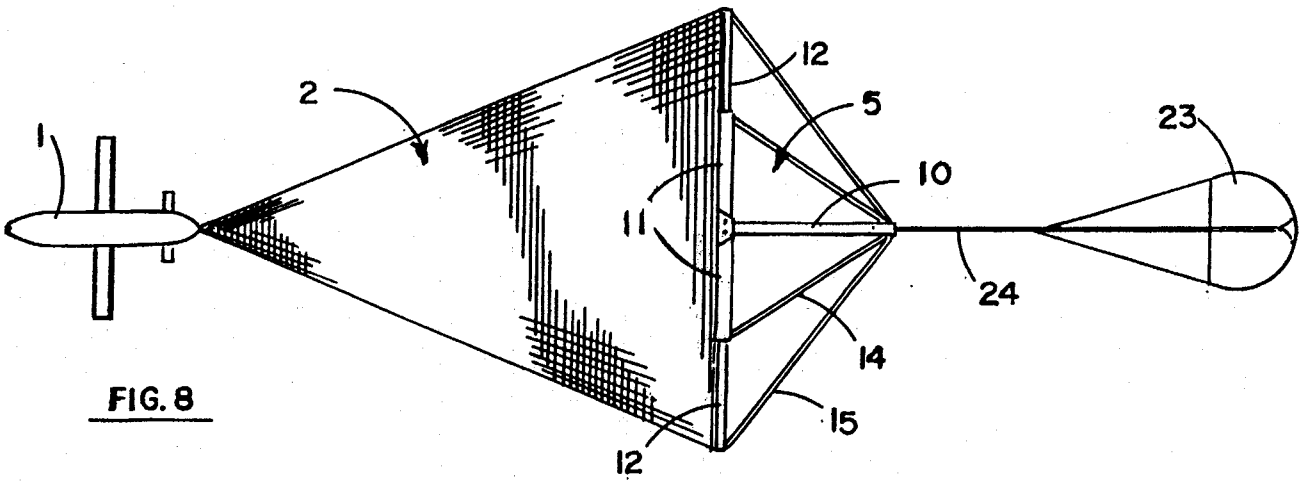
FIG. 8 depicts the stage in the net deployment at which the aft net spreader frame assembly has opened to its "fully open" configuration.

As depicted in FIG. 8, aft spreader frame 5 reaches full width when approximately one-half of net 2 has been pulled from glider 1. Because of the elongation of riser 24, parachute 23 extracts net spreader frame assembly 5 from glider 1 while maintaining tension on net 2 as net 2 expands. Flexible lines 14 and 15 maintain arm members 11 and 12 at right angles to central member 10 as long as tension is present through extraction riser 24. Each of arm members 11 and 12 contain slotted openings 35, as shown in FIG. 7, on the top and bottom of the spreader arms for the purpose of venting the rocket exhaust and for allowing rapid sinking of the spreader frame assembly if the net touches down on water.

Figure 9:
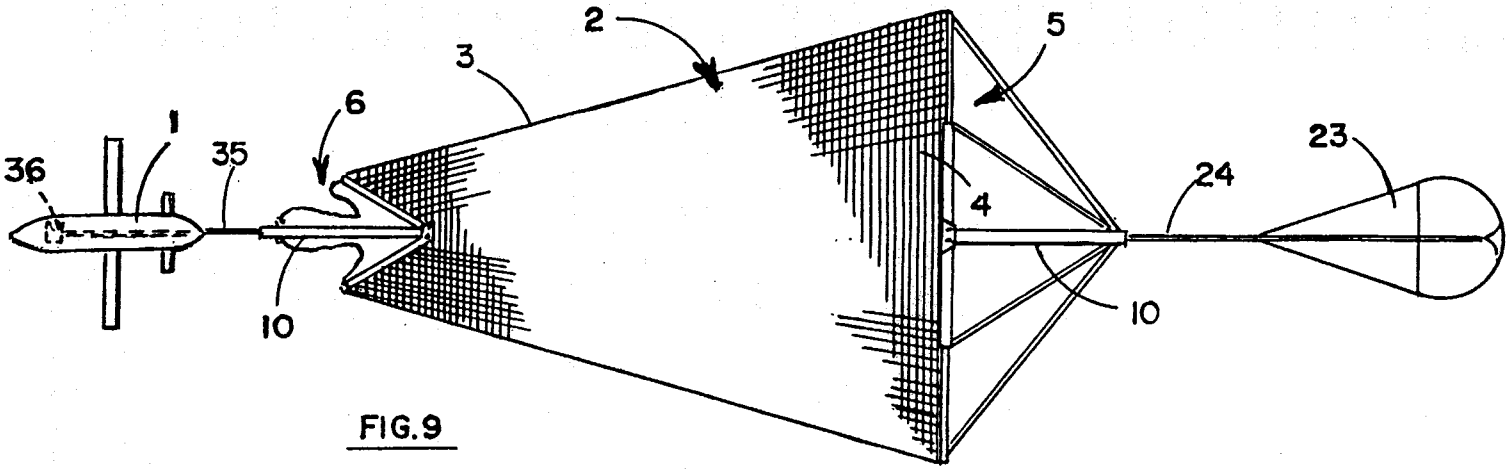
FIG. 9 depicts the stage in the net deployment at which the net has been completed extracted from the glider and the forward net spreader frame assembly has not yet opened to its "fully open" configuration.

Referring now to FIG. 9, net 2 then pulls forward net spreader frame assembly 6 from glider 1. At this point, the aft end of net 2 is nearly fully expanded and the average rate of net payout from glider 1 is greater than 70 percent of the air speed of glider 1. After forward net spreader frame assembly 6 clears glider 1, it starts to open, due primarily to unequal tensions in the longitudinal members of net 2 caused by aft frame assembly 5 being already spread out as depicted in FIG. 9.

The spreading of forward net spreader frame assembly 6 is completed by tension applied to the central member 10 by riser 35 which is connected at one end to net spreader frame assembly 6 and at the other end to a braking device such as brake reel 36. Brake reel 36 provides tension until the net has spread out completely over the target area. Aft net spreader frame assembly 5 hits the surface of the target area shortly after forward net spreader frame assembly 6 has cleared glider 1 and has opened fully as depicted in FIG. 2. If the net lands on water, the net then sinks and is detonated when it reaches the sea bottom.

Brake reel 36 incorporates a braking mechanism that maintains a consistent and relatively low level of tension through riser 35 to prevent net 2 from rebounding, thus allowing net 2 to land fully spread out upon the target area. After an appropriate length of riser 35 is paid out following net touchdown, the end of riser 35 slips off from reel 36, thus completing deployment of the net.

We claim:

1. A system for deploying an explosive net over a mine field from an air transportation vehicle comprising, an explosive net having a forward end and an aft end, an aft net spreader frame assembly, a forward net spreader frame assembly, the forward end of the explosive net being attached to the forward net spreader frame assembly and the aft end of the explosive net being attached to the aft net spreader frame assembly, an extraction device for extracting the explosive net and the aft net spreader frame assembly and the forward net spreader frame assembly from the air transportation vehicle, the forward net spreader frame assembly and the aft net spreader frame assembly being constructed so as to collapse into compact form for compact storage together with the explosive net within the air transportation vehicle and so as to open to their respective fully open configurations after extraction from the air transportation vehicle.

2. The system described in claim 1 and further comprising, a braking device attached to the air transportation vehicle and connected to the forward net spreader frame assembly.

3. The system described in claim 2 in which the explosive net comprises longitudinal explosive members and lateral members.

4. The system described in claim 2 in which the explosive net comprises longitudinal members and lateral members having explosive charges attached to the members.

5. The system described in claim 1 in which the aft net spreader frame assembly and the forward net spreader frame assembly each comprise, a rigid central member having first and second ends, first and second rigid lateral arm members hingeably attached to the first end of the central member, first and second rigid lateral telescoping arm members, a portion of each telescoping arm member being slideably located within the respective lateral arm member, a plurality of flexible members, each of which flexible member is attached between the second end of the rigid central member and one of the rigid lateral telescoping arm members or one of the rigid lateral arm members.

6. The system described in claim 1 and further comprising an extraction riser made of a high-elongation material and connecting the extraction device to the aft net spreader frame assembly.

7. The system described in claim 2 and further comprising, a riser connected between the forward net spreader frame assembly and the braking device.

8. A method for deploying an explosive net over a mine field from an air transportation vehicle, the net having a forward end and an aft end, the aft end of the net being attached to an aft net spreader frame assembly and the forward end of the net being attached to a forward net spreader frame assembly, the method comprising, collapsing the aft net spreader frame assembly and the forward net spreader frame assembly into a compact form, stowing the net and the aft net spreader frame assembly and the forward net spreader frame assembly in the air transportation vehicle, transporting the net and the aft net spreader frame assembly and the forward net spreader frame assembly to the area of deployment, extracting the aft net spreader frame assembly and a portion of the net from the air transportation vehicle, opening the aft net spreader frame assembly to its fully open position after the aft net spreader frame assembly has been extracted from the air transportation vehicle, extracting the remainder of the net and the forward net spreader frame assembly from the air transportation vehicle, opening the forward net spreader frame assembly to its fully open position after the forward net spreader frame assembly has been extracted from the air transportation vehicle, allowing the net and the aft net spreader frame assembly and the forward net spreader frame assembly in the fully open configuration to land on the deployment area.

9. A system for deploying an explosive net over a mine field from an air transportation vehicle comprising, an explosive net having a forward end and an aft end, an aft net spreader frame assembly, a forward net spreader frame assembly, the forward end of the explosive net being attached to the forward net spreader frame assembly and the aft end of the explosive net being attached to the aft net spreader frame assembly, extraction means for extracting the aft net spreader frame assembly, the net and the forward net spreader frame assembly from the air transportation vehicle, the forward net spreader frame assembly and the aft net spreader frame assembly being constructed so as to collapse into compact form for compact storage together with the explosive net within the glider and so as to open to a fully open configuration after extraction from the air transportation vehicle, opening means for opening the aft net spreader frame assembly and the forward net spreader frame assembly to their respective fully open configurations after each of them has been extracted from the air transportation vehicle.

* * * * *